United States Patent [19]

Leahy

[11] 4,424,637

[45] Jan. 10, 1984

[54] GALLERY PICTURE FRAME

[75] Inventor: David J. Leahy, Framingham, Mass.

[73] Assignee: Dennison Manufacturing Company, Framingham, Mass.

[21] Appl. No.: 332,421

[22] Filed: Dec. 21, 1981

[51] Int. Cl.[3] ..... G09F 1/12

[52] U.S. Cl. ..... 40/152; 40/158 R

[58] Field of Search ..... 40/158, 158 B, 152, 40/152.1, 158 R

[56] References Cited

U.S. PATENT DOCUMENTS

| | | | |
|---|---|---|---|
| 1,549,389 | 8/1925 | Simon | 40/158 R |
| 2,521,603 | 9/1950 | Prew | 40/152 |
| 2,593,195 | 4/1952 | Rosenberg | 40/158 R |
| 2,896,351 | 7/1959 | Johnson | 40/158 B |
| 2,936,540 | 5/1960 | Power | 40/489 |
| 3,304,641 | 2/1967 | Gonczy | 40/158 R |
| 3,650,057 | 3/1972 | Johnson et al. | 40/158 R |
| 4,057,923 | 11/1977 | Chase | 40/158 R |

*Primary Examiner*—Gene Mancene
*Assistant Examiner*—Wenceslo J. Contreras
*Attorney, Agent, or Firm*—Barry D. Josephs; Arthur B. Moore; George E. Kersey

[57] ABSTRACT

A lightweight picture frame for securely holding a gallery of photographic snapshots or pictures in a vertical position. A mounting panel is included composed of an adhesive coated backing sheet overlaid with a release sheet removeable in preselected areas. The adhesive coating is a pressure sensitive adhesive which secures the snapshots to the mounting panel and permits removal of the snapshots without causing damage to them. The picture frame may include additional panels to provide individual borders around each photograph, and also includes a frame member for securing the panels in a locked position.

12 Claims, 6 Drawing Figures

GALLERY PICTURE FRAME

BACKGROUND OF THE INVENTION

1. Field of the Invention

The present invention relates to a picture frame for holding a gallery of various snapshots and pictures securely mounted to the frame to permit display of the pictures therein in a vertical position.

2. Description of the Prior Art

The prior art discloses a variety of picture frames designed for display of a gallery of snapshots or pictures. The prior art frames may contain individual cubicle units of varied depths with snapshots housed therein to give an enhanced three-dimensional effect upon display of the gallery. In this type of frame, since each one of the pictures is housed in an individual cubicle, there is generally no problem with slippage or disorientation of the pictures when the frame is held in a vertical display position, for example, on a wall surface. However, galleries of this type are difficult to fabricate because the cubicles are of different depths and the difficulty of manufacture adds considerably to the cost of the frame.

In another variety of gallery picture frames the frame is of uniform depth; that is, the frame has an essentially flat appearance and usually is composed of a glass front panel and a pair of panels sandwiching the snapshots. One panel typically has cut-out portions through which the individual snapshots are visible and the other essentially is a flat sheet. Conventionally, a heavyweight border, typically composed of wood, metal or heavy plastic construction, borders and secures the panels. The disadvantage of this type of display device is that pictures or photographs tend to become disoriented as the user attempts to position them in the mounting panels, or during later handling of the display. Normally, therefore, the user must employ external adhesive means in order to firmly secure the pictures to the mounting member, which requires additional effort and may prevent exchange of photographs.

In U.S. Pat. No. 4,008,852, a mailing card is disclosed having an adhesive coated mounting section on the card with a removable release sheet covering the adhesive coated layer. The disclosed mounting member is used to secure snapshots in connection with mailing cards. Removal of the pictures and reuse of the adhesive for substituted pictures is not contemplated. This reference is also not concerned with display of a plurality of snapshots in gallery fashion employing a multiplicity of panels which is the subject of Applicant's invention.

SUMMARY OF THE INVENTION

The display device of the present invention is of a lightweight construction particularly suitable for holding a multiplicity of photographs or the like in a gallery arrangement. The display device includes a clear translucent front panel, preferably of lightweight plastic having the appearance of glass, and further includes a mounting laminate. The mounting laminate includes a lightweight backing sheet of cardboard or paper construction coated with a pressure sensitive adhesive. The adhesive coated backing sheet is overlaid with a release sheet, typically of paper construction. The release sheet is removable from the backing sheet along predesignated areas on the surface of the mounting laminate. The adhesive coating is preferably composed of a pressure sensitive type adhesive, which permits removal of the pictures after they have been affixed to the adhesive coated sheet but yet retains sufficient adhesive properties to secure substitute pictures. A suitable adhesive having the aforementioned properties is a rubber-based pressure sensitive adhesive such as an adhesive containing polyisobutylene or styrene butadiene rubber or natural rubber or mixtures thereof in compatible solvents. A preferred adhesive is one containing a mixture of polyisobutylene and mineral oil plasticizer dissolved in compatible hydrocarbon solvent.

The picture frame may include additional panels. For example, a middle panel having individual cutout portions providing a frame border around each individual picture may be included between the translucent front panel and the mounting panel. The middle panel is also of lightweight construction, typically of cardboard material. The picture frame may include an additional member such as a back panel to provide rigid support to the composite picture frame. The individual panels are releasably secured by a frame member composed of arms, including at least one pair of adjacent arms detachable along a common joint.

When the detachable frame arms are opened, the individual panels of the picture frame become separable. Upon separating the panels, the user may attach pictures or photos along the predesignated areas on slots in the mounting panel by removing the release sheet from the mounting panel and affixing the picture to the exposed adhesive backing sheet within the slot. After all the desired pictures have been mounted, the panels may then be reassembled and the frame member then secured around the periphery of the assembled panels. The frame arms are then closed in a locked position to hold the panels securely in place.

The present invention has the advantage over prior art gallery type picture frames in that the composite picture frame is of lightweight construction and permits the user to removably secure pictures or photos in designated areas without resorting to external adhesive or fastening means to hold the pictures firmly against the mounting member. This provides for convenient use of the picture frame to securely display a multiplicity of photos or pictures in an upright position. The present invention allows for easy assembly or disassembly of the frame and easy removal of the individual photos or pictures from the mounting member without causing damage to the individual pictures. The invention also provides for easy rearrangement of the pictures and substitution of other pictures in place of those which have been removed.

DETAILED DESCRIPTION

Figure 1:
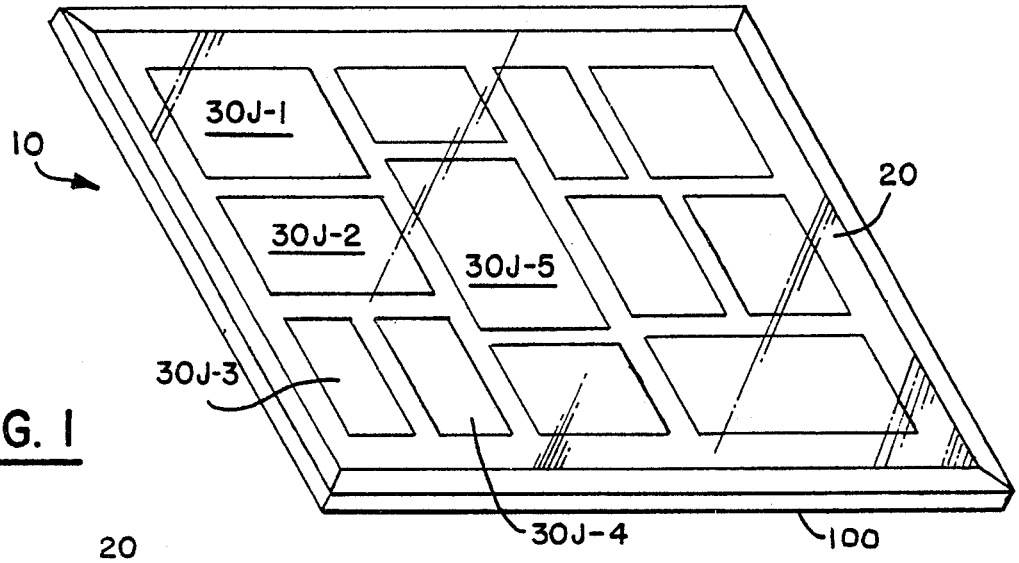
FIG. 1 is a plan view of the gallery picture frame.

A preferred embodiment of the gallery picture frame of the invention is illustrated in FIGS. 1 through 6. As seen in FIG. 1, picture frame 10 is composed of a translucent front panel 20, a middle panel 30, a mounting member such as a mounting panel 50, and back panel 70.

Figure 2:
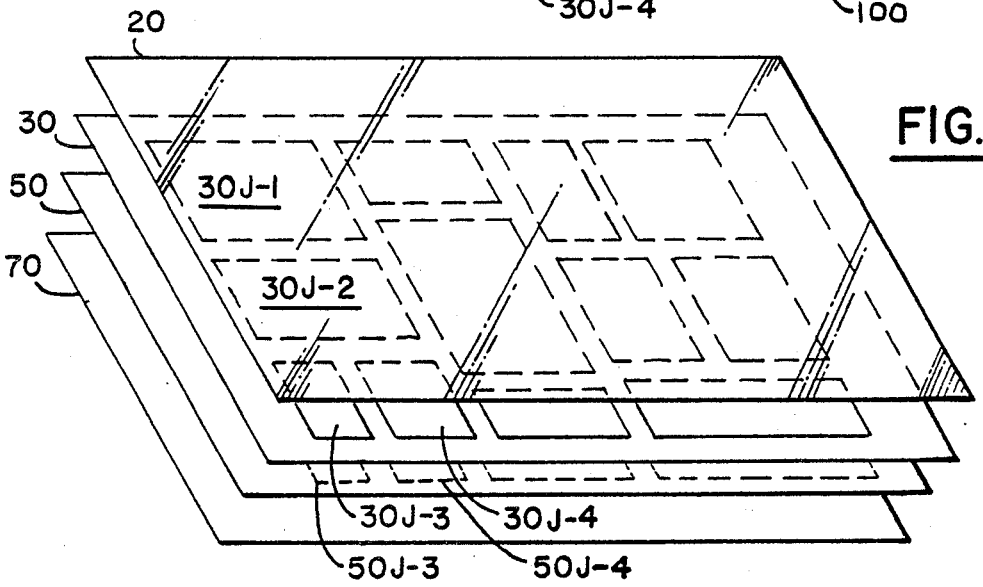
FIG. 2 is an isometric illustration showing the arrangement of panels in the gallery picture frame.

Panels 30 and 50 are preferably sandwiched between front panel 20 and back panel 70 as illustrated in FIG. 2. Picture frame 10 also includes a frame member 100 which surrounds the panels in a closed, secure position as shown in FIG. 1. The frame member 100 is composed of releasable arms such as arms 102, 104, 106 and 108, which can be spread apart manually. At least one pair of adjacent arms, arms 102 and 108, are detachable at a common joint. When arms 102 and 108 are opened, the panels easily separate one from the other and pictures may then be inserted. The panels may then be rearranged in proper order and frame member 100 closed around the periphery of the panels to hold them in a secure, locked position.

Front panel 20 is a translucent member preferably composed of a clear plastic sheet. It has been determined that a front panel 20 composed of clear polystyrene is particularly desirable. The polystyrene may typically be about 10 mil in thickness and produces a uniform, highly transparent sheet which is economical and sufficiently impact resistant for the intended use. Use of clear polystyrene for panel 20 also has the advantage that it gives the appearance of glass when the picture frame is viewed from a distance. Although clear polystyrene is the preferred plastic for front panel 20, it has been determined that suitable alternative materials are clear Mylar (polyester), clear polypropylene, cellulose acetate, or polycarbonate. Clear plastic sheets formed from the foregoing alternative materials are readily manufactured and have suitable impact resistance and sufficient clarity for use in the present invention. Additionally, it should be understood that panel 20 may be composed of other clear plastics and also glass may be used. However, glass has the disadvantage of being heavier thus requiring heavier frame construction and consequently a more costly picture frame.

Figure 5:
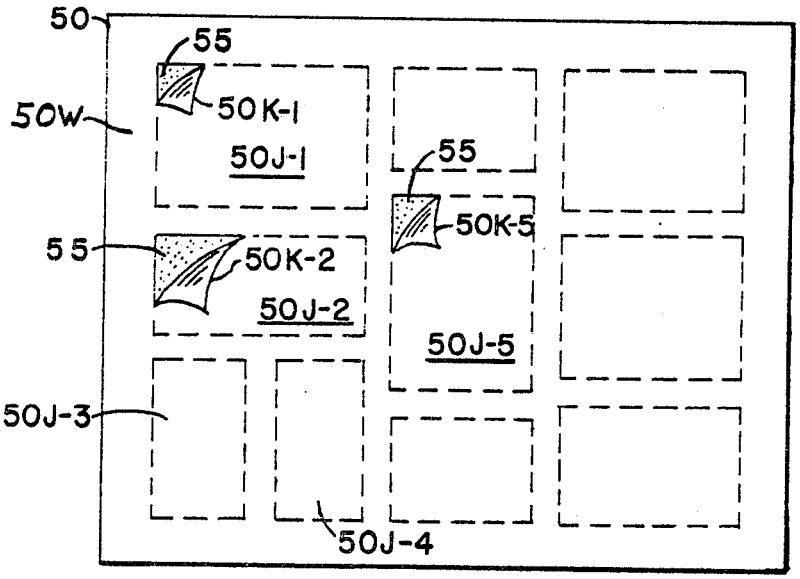
FIG. 5 is a plan view of the mounting panel.
Figure 6:
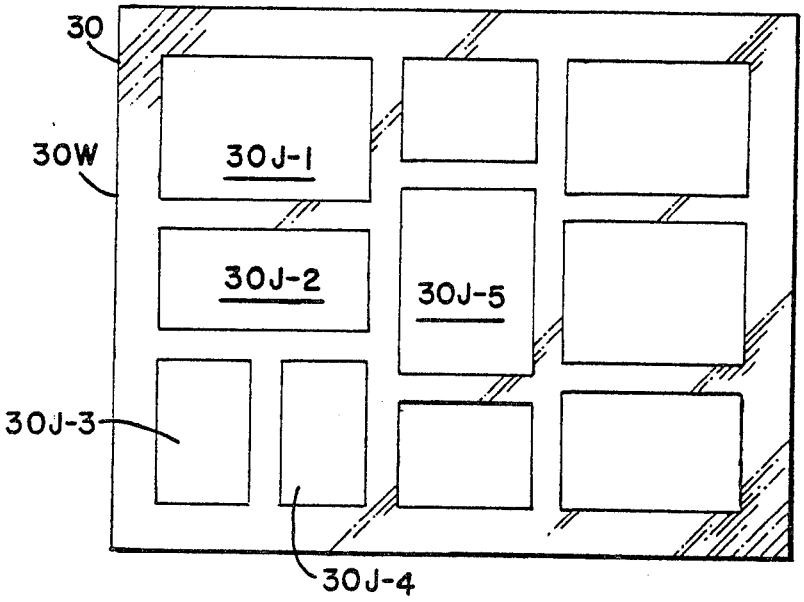
FIG. 6 is a plan view of the middle panel.

Middle panel 30 may typically be a cardboard sheet. Middle panel 30 has a plurality of cutout portions therein, typically forming openings of various sizes and shapes such as openings 30J1, 30J2, 30J3, 30J4, and 30J5. These cutout portions provide a frame border covering pictures or photographs which are mounted to mounting panel 50. Mounting panel 50 is typically of lightweight paper construction and is composed of a backing sheet 55, uniformly or spot-coated with pressure sensitive adhesive and a removable release sheet such as sheet 50K1, which is removable from the adhesive layer 55 along various predesignated areas of the mounting panel 50. The predesignated areas of mounting panel 50 form picture slots of varied sizes and shapes such as slots 50J-1, 50J-2, 50J-3, 50J-4, and 50J-5. These slots are approximately all the same size and shape as the corresponding panel opening of middle panel 30, for example, picture slots 50J-1 through 50J-5 shown in the mounting panel 50 of FIG. 5 are approximately the same size and shape as panel openings 30J-1 through 30J-5 shown in middle panel 30 of FIG. 6. The removable release sheet for each one of the picture slots shown in mounting panel 50, for example release sheet 50K-1, is perforated along the border of the corresponding slot 50J-1 so as to permit manual removal from the adhesive coated backing sheet 55. Thus, the adhesive coated backing sheet becomes exposed in any one of the picture slots by simply peeling the corresponding release sheets. For example, release sheet 50K-1 may be peeled away thus exposing the adhesive coated backing sheet 55 within the slot portion 50J-1. Similarly, the release sheets covering the other picture slots in mounting panel 50 may be peeled away to expose the adhesive layer 55. For example, release sheet 50K-2 may be peeled away, exposing the adhesive coated backing sheet 55 within slot 50J-2. In use, after each one of the release sheets has been peeled from mounting panel 50, pictures or photographs may be cut to the size of each one of the picture slots and affixed to the exposed adhesive layer 55 within each slot. If desired, the user may use the release sheet as a template in trimming the picture or photograph to the size of the corresponding slot.

Mounting panel 50 is made by coating backing sheet 55 with an adhesive by conventional coating techniques. The adhesive is preferably uniformly coated onto one surface of backing sheet 55 which is typically of lightweight cardboard or heavy paper construction. The coated backing sheet 55 is overlaid with a release sheet, typically a paper sheet coated with a suitable silicone release agent to permit easy removal of the release sheet from the adhesive coated backing sheet 55. To facilitate easy removal of the release sheet, the release sheet is perforated along the edges of predesignated areas on the release sheet surface to form corresponding picture slots, such as, for example slots 50J-5 through 50J-5. The preperforated areas of the release sheet, for example release sheet 50K-1 through 50K-5, are easily peelable from the backing sheet 55 along their perforated edges to form an exposed adhesive coated backing portion for the corresponding slot.

The adhesive coating is preferably a pressure sensitive adhesive which has the characteristic of holding the pictures securely in place against backing sheet 55 but permitting easy removal of the pictures therefrom. The adhesive may be reused without notably losing tack. This permits the user to remove pictures from one slot and place them into another slot or remove them entirely from the picture frame and substitute other photographs or pictures in their place.

A preferred pressure sensitive adhesive having the desired characteristics comprises a rubber-based pressure sensitive adhesive mixed with compatible solvents. One rubber-based pressure sensitive adhesive having the aforementioned desirable properties is composed of a solution of polyisobutylene and mineral oil plasticizer, all dissolved in a compatible hexane solvent. The polyisobutylene adhesive is typically composed of mixtures of polyisobutylene having molecular weight ranging between about 10,000 to 80,000, although polyisobutylene of singular molecular weight in this range would also be suitable. Tackifiers such as polyterpene may be added to increase the tack of the adhesive to the desired level. During the manufacture of the adhesive coated backing sheet 55, the adhesive composed of a solution of polyisobutylene, mineral oil, plasticizer and dissolved hexane solvent with tackifier if employed, is typically coated to a weight of about 16 pounds per ream (25"×38"×500 sheets per ream) and dried in a conventional convective dryer to evaporate the solvent. The adhesive coated backing sheet 55 is then overlaid with a conventional silicone coated paper release sheet to form the composite mounting panel 50. Alternate types of conventional pressure sensitive adhesives permitting removal of photos and pictures from the adhesive backing 55 may be an adhesive solution composed of typically styrene butadiene rubber (SBR) rubber or a natural rubber dissolved in compatible solvents such as heptane, toluene and compatible mineral spirits; for example, medium boiling naphtha. Tackifiers such as polyterpene or hydrogenated rosin esters are conventionally added to the adhesive solution to increase the tack of the adhesive to the desired level. Another suitable pressure sensitive adhesive permitting removal of photos or pictures from the backing sheet may, for example, have an acrylic base instead of rubber base in which a typical compatible solvent may be, for example, ethyl acetate instead of heptane or toluene. Acrylic-based pressure sensitive adhesives having the aforementioned desirable characteristics are available in the commercial market.

Back member 70 may be any member suitable for providing backing support to the panels 20, 30 and 50. Preferably, back member 70 is a uniform panel of heavy-duty cardboard construction. However, it should be appreciated that other materials may be used for back panel 70 such as, for example, lightweight plastic or wood. However, cardboard construction is preferred since it is less expensive than other materials and is sufficiently lightweight and durable.

Figure 3:
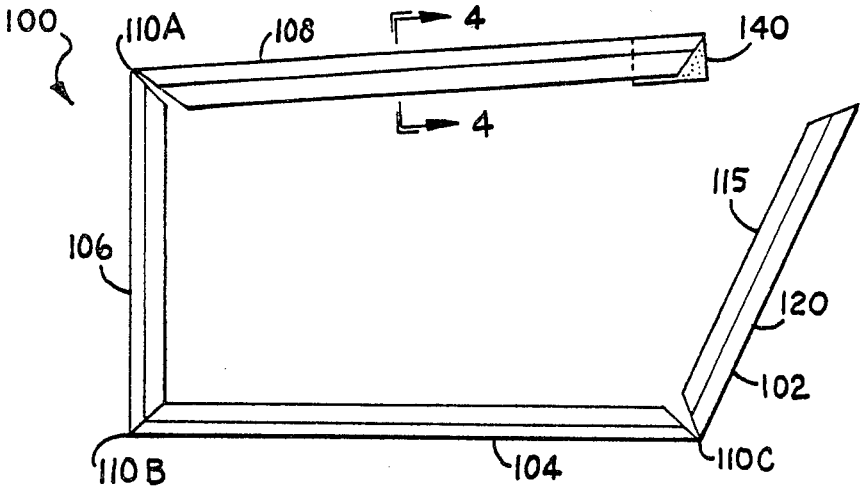
FIG. 3 is a plan view of the frame member in an open position for removal of the panels.
Figure 4:
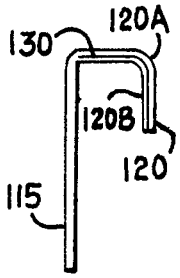
FIG. 4 is a sectional end view of the frame member taken along the lines 4—4 of FIG. 3.

Frame member 100 is preferably of plastic construction, which may be partially or fully coated with a decorative metallic aluminum coating layer. Frame member 100 is composed of a plurality of arms, for example, arms 102, 104, 106 and 108. Pairs of adjacent arms are joined along a common edge by flexible joints. For example, arms 106 and 108, as illustrated in FIG. 3, are joined along flexible joint 110A. Similarly arms 104 and 106 are joined together by flexible joint 110B, and arms 102 and 104 are joined by joint 110C. The joints may be composed of a hinge, but preferably are formed of bendable plastic integral with the adjacent arms. Although four arms are illustrated in FIG. 3, it should be appreciated that fewer or greater number of arms may be utilized without departing from the concept of the present invention. At least one joint of the frame member 100 allows a pair of adjacent arms, e.g. arms 102 and 108 to be detached one from the other. When these arms are detached and the remaining arms opened along the flexible joints, the frame member 100 is easily removed from the panels and the panels may then be readily separated. The user may then access mounting panel 50 to mount new photos or remove photos already mounted. Frame 100 may then be placed around the panels and detached arms 102 and 108 rejoined to secure the panels. These arms may be rejoined to each other by a corner tape 140, which is affixed to either one of the arms at the detachable joint. A convenient type of corner tape 140 may be a metallized Mylar tape, which is commercially available.

The frame member 100 is composed preferably of lightweight plastic construction. Since the total weight of the panels 20, 30, 50 and 70 is very light, frame member 100 may also be of lightweight material, desirably of lightweight plastic construction. Frame member 100 may be composed of back leg 115 and a shorter front leg 120B, the front leg facing the viewer when the frame is placed in its normal upright position. The back leg 115 and front leg 120B may be integrally molded or extruded, for example, employing suitable lightweight durable plastic such as polystyrene-A-B-S resin. To provide additional strength, the front leg 120B may have a reinforcing bar of metal construction, for example, aluminum placed therein during the molding process. Front leg 120B may be overcoated with a metallized layer of aluminum deposited onto the leg by conventional vacuum metallization processes or other conventional techniques.

The preferred picture frame is of lightweight construction and may be any size typically $8\frac{1}{2} \times 11$ inches or $11 \times 14$ inches. The front panel 20 is typically of a thickness of about 10 mil and has a basis weight of about 200 to 300 gms./m$^2$. The middle panel 30 is typically of lightweight cardboard construction having a basis weight desirably of between about 500 to 700 gms/m$^2$. Mounting member 50 is desirably of heavy paper construction having a total weight including adhesive coating of about 150 to 250 gms./m$^2$, and backing panel 70 is normally of heavy duty cardboard, having a basis weight of the panels 20, 30, 50 and 70 have a basis weight typically of about 1350 to 1950 gms./m$^2$.

It should be appreciated that the present invention is not limited to any particular overall shape or configuration. Also it should be realized that the invention is not limited to any particular number, size, or shape of the individual picture slots in mounting panel 50. The foregoing description is merely representative of a specific preferred embodiment of the invention and is not intended to limit the scope of equivalent structures or arrangements. Thus, the invention is not intended to be limited by the description in the specification but rather is defined by the claims and equivalents thereof.

I claim:

1. A display device for a plurality of snapshots and the like which comprises:

a mounting panel comprised of an adhesive coated cardboard or paper backing sheet overlaid with a release sheet removable from said adhesive coated backing sheet in a plurality of sections of predetermined sizes and shapes to form a plurality of mounting sections with exposed adhesive therein, said adhesive being a pressure sensitive adhesive of a reuseable type permitting secure bonding between the snapshot and said mounting section, and yet permitting manual removal of the snapshots therefrom and replacement of said removed snapshots with substitute snapshots in said mounting section;

a translucent front panel, and a middle panel releaseably located between the front panel and mounting panel without adhesively securing any one of said panels to any other of said panels, said middle panel having portions defining a plurality of cutout sections therein, the cutout sections corresponding substantially to the size and shape of the mounting sections, and means for holding the mounting member, middle panel, and front panel together in locked position, said means being releasable to permit separation of the mounting member, middle panel and front panel and relockable to hold the mounting member, middle panel and front panel together in locked position, said means comprising a frame member having at least one pair of adjacent arms which are detachable and relockable at a common joint.

2. A display device as in claim 1 wherein the front panel is comprised of translucent plastic material.

3. A display device as in claim 1 further comprising a back panel positioned behind the mounting member so that the mounting member lies between the back panel and front panel.

4. A display device as in claim 1 which includes means for relocking said adjacent arms.

5. A display device as in claim 1 wherein the frame member is further comprised of at least one pair of adjacent arms joined by a flexible joint.

6. A display device as in claim 1 wherein the front panel is comprised of translucent polystyrene plastic.

7. A display device as in claim 1 wherein the middle panel is comprised of cardboard material.

8. A display device as in claim 3 wherein the back panel is comprised of cardboard material.

9. A display device as in claim 1 wherein the frame member is comprised of a lightweight plastic material.

10. A display device as in claim 1 wherein the front panel is comprised of translucent polypropylene plastic.

11. A display device as in claim 1 wherein the front panel is comprised of translucent cellulose acetate plastic.

12. A display device as in claim 1 wherein the front panel is comprised of translucent polycarbonate plastic.

* * * * *